US008915560B2

(12) United States Patent
Cox et al.

(10) Patent No.: US 8,915,560 B2
(45) Date of Patent: Dec. 23, 2014

(54) TWIST-PREVENTING APPARATUS FOR MOUNTING A RACK IN A DISHWASHER

(71) Applicant: Whirlpool Corporation, Benton Harbor, MI (US)

(72) Inventors: Rayburn L. Cox, Saint Joseph, MI (US); Christopher C. Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 18 days.

(21) Appl. No.: 13/685,763

(22) Filed: Nov. 27, 2012

(65) Prior Publication Data

US 2014/0145573 A1 May 29, 2014

(51) Int. Cl.
*A47B 77/06* (2006.01)
*A47L 15/50* (2006.01)

(52) U.S. Cl.
CPC ..... *A47L 15/50* (2013.01); *A47L 15/507* (2013.01); *A47L 15/504* (2013.01)
USPC ..... 312/228; 312/311

(58) Field of Classification Search
USPC ..... 312/228, 228.1, 309–311, 321, 312/334.1–334.2, 334.7, 334.8
See application file for complete search history.

(56) References Cited

U.S. PATENT DOCUMENTS

| | | | | |
|---|---|---|---|---|
| 3,095,250 | A * | 6/1963 | Frederick | 312/334.21 |
| 3,194,610 | A * | 7/1965 | Stewart | 384/19 |
| 3,214,227 | A * | 10/1965 | Filipowicz | 312/71 |
| 3,347,612 | A * | 10/1967 | Bebinger | 312/311 |
| 3,990,756 | A * | 11/1976 | Han | 312/311 |
| 4,449,765 | A * | 5/1984 | Lampman | 312/311 |
| 6,213,027 | B1 * | 4/2001 | Landrot | 105/182.1 |
| 6,397,863 | B1 * | 6/2002 | Cadima | 134/25.2 |
| 6,755,490 | B2 * | 6/2004 | Welch et al. | 312/228.1 |
| 7,410,228 | B2 | 8/2008 | Dickson et al. | |
| 7,445,013 | B2 | 11/2008 | Vanderroest et al. | |
| 7,523,758 | B2 | 4/2009 | Vanderroest et al. | |
| 7,594,707 | B2 * | 9/2009 | Kunkle et al. | 312/402 |
| 2005/0150523 | A1 * | 7/2005 | Schock | 134/25.2 |
| 2006/0250058 | A1 * | 11/2006 | Stevens et al. | 312/311 |
| 2011/0018410 | A1 * | 1/2011 | Bastuji et al. | 312/228.1 |
| 2012/0291824 | A1 * | 11/2012 | Bhajak et al. | 134/135 |

FOREIGN PATENT DOCUMENTS

| | | |
|---|---|---|
| EP | 1321093 A2 | 6/2003 |
| EP | 1356759 A2 | 10/2003 |

OTHER PUBLICATIONS

European Search Report for Corresponding EP 13194558.6, Feb. 12, 2014.

* cited by examiner

*Primary Examiner* — Daniel Rohrhoff

(57) ABSTRACT

A disclosed example dishwasher includes a tub at least partially defining a treating chamber, a rack for holding utensils for treatment within the treating chamber, a first wheel coupled with the tub, a second wheel coupled with the rack at an angle other than perpendicular, and a track. The track can have first and second channels in a back-to-back relationship for respectively receiving the first and second wheels to slidably mount the rack to the tub.

13 Claims, 5 Drawing Sheets

TWIST-PREVENTING APPARATUS FOR MOUNTING A RACK IN A DISHWASHER

FIELD OF DISCLOSURE

This disclosure relates generally to rack mounting arrangements for dishwashers, and more particularly to rail systems that prevent twisting of the rail system.

BACKGROUND

Dishwashers include a treating chamber in which utensils are placed to be washed according to an automatic cycle of operation. Typically, at least one rack is located in the treating chamber for holding utensils to be cleaned. In dishwashers where the treating chamber is accessible through a moveable door, one or more rack(s) can be slidably mounted within the treating chamber in such a manner that at least a major portion of the rack(s) can be slid substantially beyond the treating chamber to ease the loading of the racks.

SUMMARY

A disclosed example dishwasher includes a tub at least partially defining a treating chamber and having at least one side, a rack for holding utensils for treatment within the treating chamber, a first wheel mounted to the at least one side of the tub, a second wheel mounted to the rack at an angle other than perpendicular, and a track having a first C-shaped channel receiving the first wheel and a second C-shaped channel receiving the second wheel to slidably mount the rack to the tub, with the first and second C-shaped channels in a back-to-back relationship.

DETAILED DESCRIPTION

The examples disclosed herein provide a rail system for a dishwasher that has improved performance over previous rail systems. Advantages that may be realized by the example rail systems disclosed herein are that the rail system will twist less thereby increasing visual appeal and perceived quality, the rail system may operate more smoothly, and/or rubbing of a tub seal by the rail system may be reduced.

Figure 1:
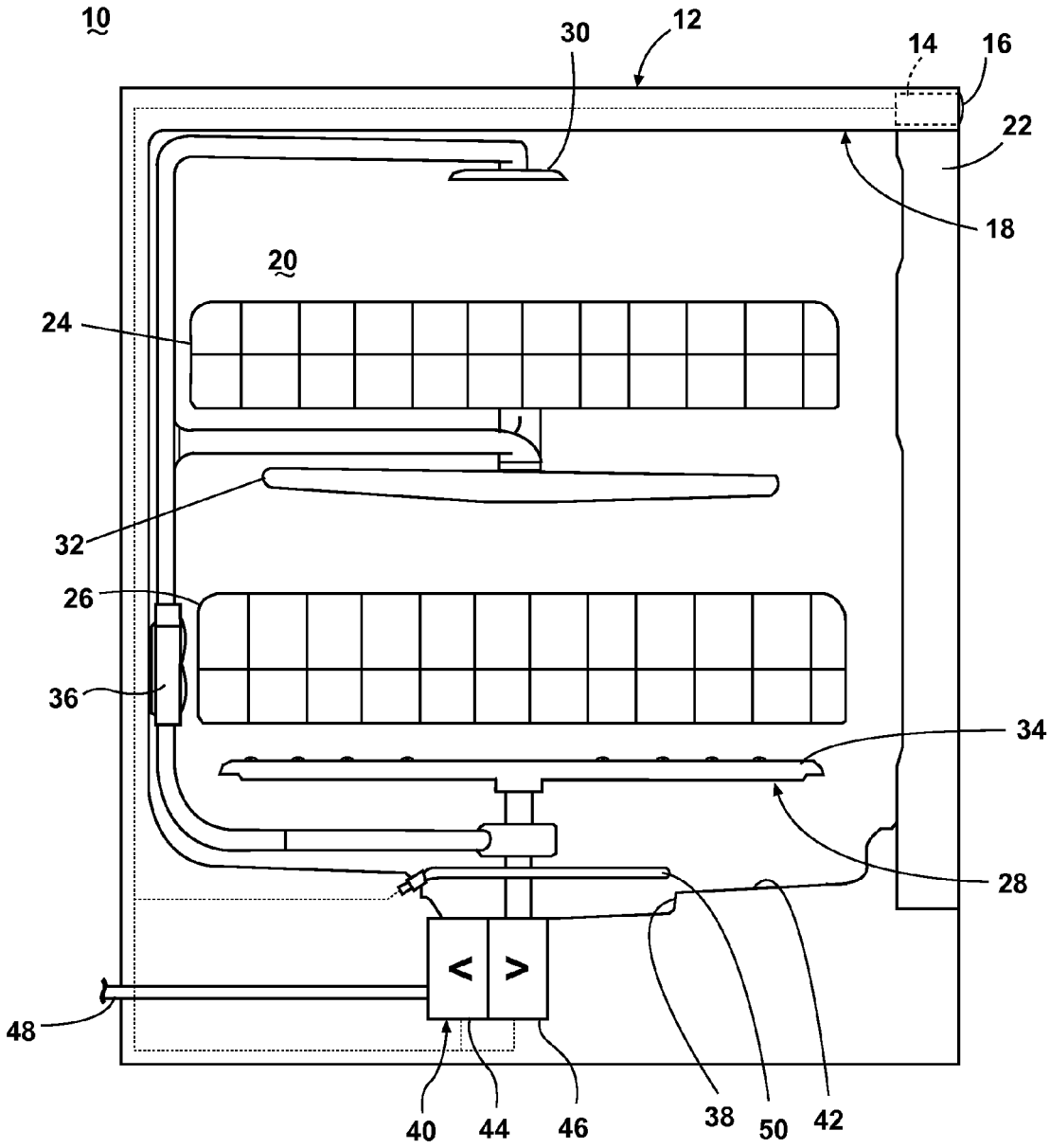
FIG. 1 is a schematic cross-sectional view of an automatic dishwasher including a twist-preventing rail system.

FIG. 1 is a schematic cross-sectional view of an automatic dishwasher 10 including a twist-preventing rail system. While example cambered wheels for use with a double C-channel rail system to provide twist prevention are disclosed herein, the cambered wheels disclosed herein may be used with other rail systems such as, but not limited to, a rail system having a single C-channel and two vertical wheels to mount the rail system to an interior side wall of a dishwasher. Moreover, while the example cambered wheels and example twist-preventing rail systems disclosed herein may be used to hold utensil holders, the example cambered wheels and twist-preventing rail systems may be used to hold other items such as a dishwasher drawer and/or any other slidably mounted object (e.g., a trash can, a storage drawer, etc.). Further still, while the cambered wheels are mounted to the utensil rack in the examples disclosed herein, the cambered wheels may alternatively be mounted to the interior side wall of a dishwasher.

The dishwasher 10 includes a cabinet 12 defining an interior. Depending on whether the dishwasher 10 is a stand-alone or built-in, the cabinet 12 may be a chassis/frame with or without panels attached, respectively.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

Figure 2:
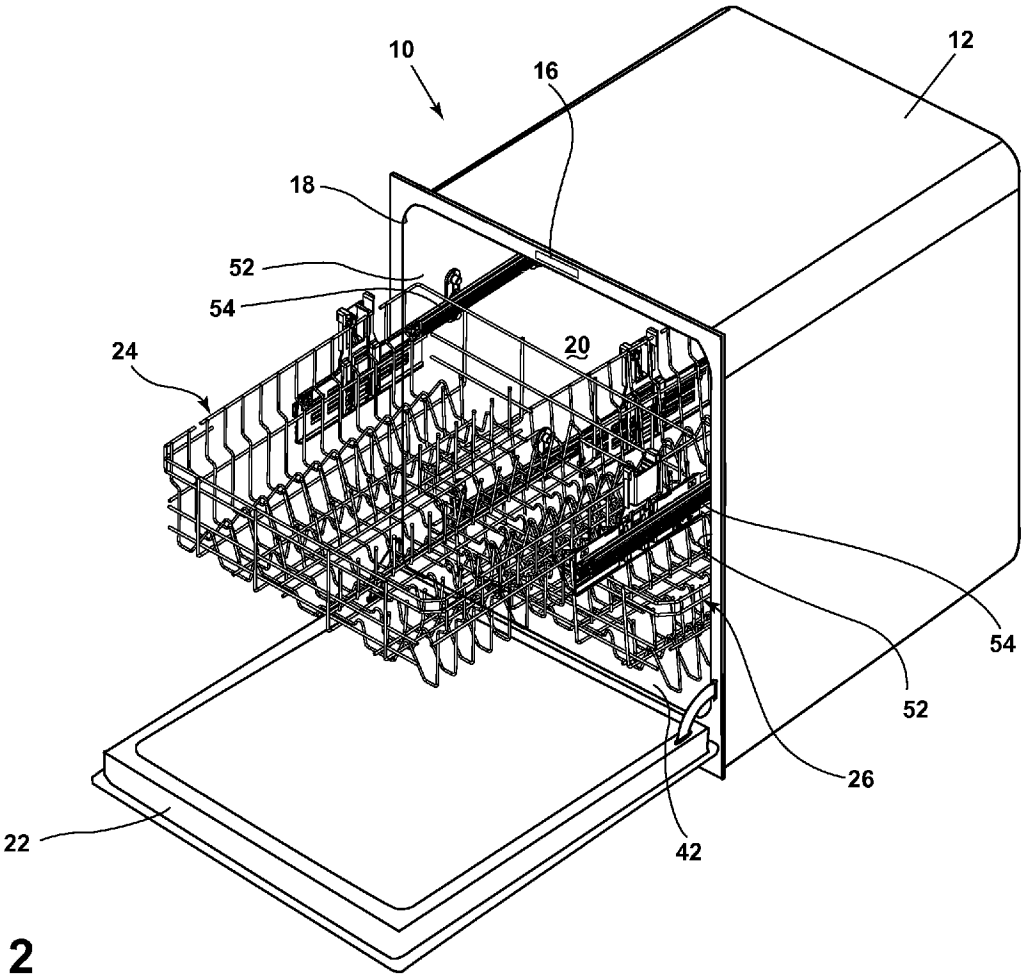
FIG. 2 is a front isometric view of the automatic dishwasher of FIG. 1 illustrating an upper rack mounted to the dishwasher by the twist-preventing rail system of FIG. 1.

A tub 18 is located within the cabinet 12 and at least partially defines a treating chamber 20 with an access opening in the form of an open face. A cover, illustrated as a door 22, may be hingedly mounted to the cabinet 12 and may move between an opened position, as shown in FIG. 2, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for treatment. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20, and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath the upper rack 24 and the lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38. A heating system having a heater 50 may be located within or near a lower portion of the tub 18 for heating liquid contained therein.

FIG. 2 is a front perspective view of the automatic dishwasher 10 of FIG. 1, with the door 22 in an open position. The tub 18 includes spaced-apart opposing side walls 52. At least the upper rack 24 is coupled to the tub 18 by a rail system 54 for mounting the upper rack 24 to the side walls 52 of the tub 18. At least the side walls 52 of the tub 18 can be flexible, for example, by limiting the underlying support structure (not shown) in the vicinity of the rail system 54, thereby, allowing the side walls 52 to flex, and/or by being constructed of in a flexible thin panel of material, such as polypropylene or stainless steel.

The rail system 54 comprises a pair of rail assemblies 56 (see FIG. 3), one associated with each side wall 52 of the tub 18 and which couples one lateral side of the rack 24 to the tub 18. While not described herein, the lower rack 26 can also be coupled to the side walls 52 of the tub 18 by a similar rail system 54. The racks 24, 26 are moveable between a first or cycle position in which the racks 24, 26 are received within the treating chamber 20 and the door 22 can be closed in order to begin a cycle of operation, and a second or loading position in which the door 22 is open and the racks 24, 26 are slid at least partially out of the treating chamber 20 for ease of loading and unloading utensils from the racks 24, 26. In FIG. 2, the lower rack 26 is shown in the first/cycle position, and the upper rack 24 is shown in the second/loading position.

Figure 3:
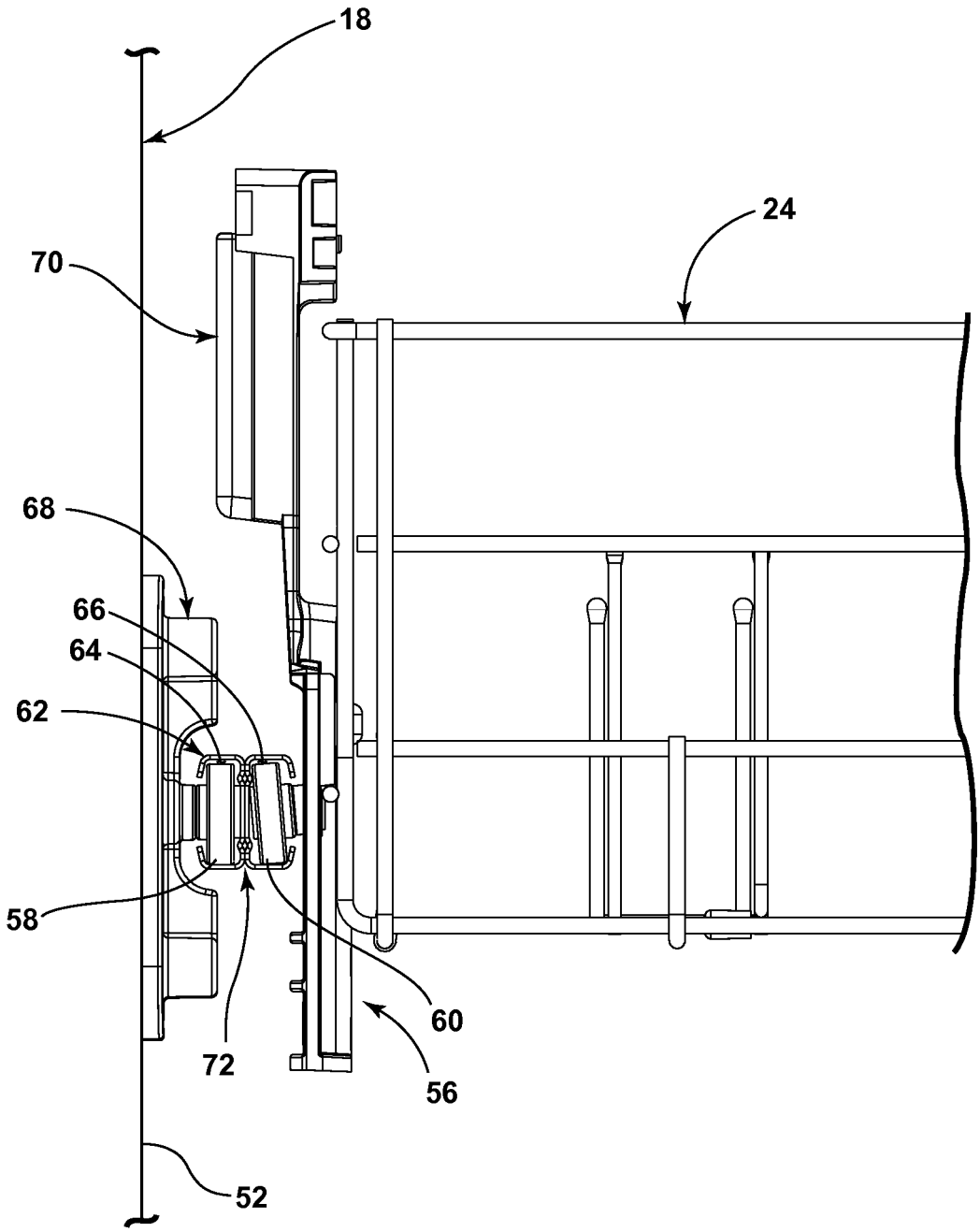
FIG. 3 is a front view of the twist-preventing rail assembly of FIG. 2.

FIG. 3 is a front view of a portion of the dishwasher 10, illustrating the upper rack 24 mounted to the dishwasher 10 by the rail assembly 56. Each rail assembly 56 includes at least one first wheel 58 mounted to the side wall 52 of the tub 18 and at least one second wheel 60 mounted to the rack 24, and a track 62 which is configured to receive both wheels 58, 60 to slidably mount the rack 24 to the tub 18. The track 62 can have a first C-shaped channel 64 and a second C-shaped channel 66 arranged in a back-to-back relationship, which each C-shaped channel 64, 66 adapted to receive one of the wheels 58, 60.

In the illustrated embodiment, each rail assembly 56 further includes one or more tub mounting bracket(s) 68 and a rack mount 70. The tub mounting bracket(s) 68 are fixedly mounted to the side wall 52 of the tub 18, and mount the first wheel 68, which is received within the first C-shaped channel 64 of the track 62. The rack mount 70 attaches to the rack 24 and carries the second wheel 60, which is received within the second C-shaped channel 66 of the track 62. The C-shaped channels 64, 66 of the track 62 can be separated by a partition 72 extending between the channels 64, 66, thereby dividing the channels 64, 66 into separate raceways for the wheels 58, 60.

Compared to previous rail systems, the wheel 60 (which is rotatably mounted to the upper rack 24) is intentionally cambered. The angle at which the wheel 60 is cambered is selected so that substantially all of the slop between components (i.e., track 62, wheel 60, axle, etc.) is taken out and the rail 62 is substantially straight. In some examples, the wheel 60 is cambered downward by 3 degrees. By removing the slop, the ability of a downward force applied to the rail assembly 56 due to, for example, the weight of utensils in the upper rack 24, to rotate, twist or deflect the rail 62 is substantially eliminated or reduced. In stark contrast, when the wheel 60 is not cambered, a downward force will rotate or twist the rail 62 until the slop is removed.

Figure 4:
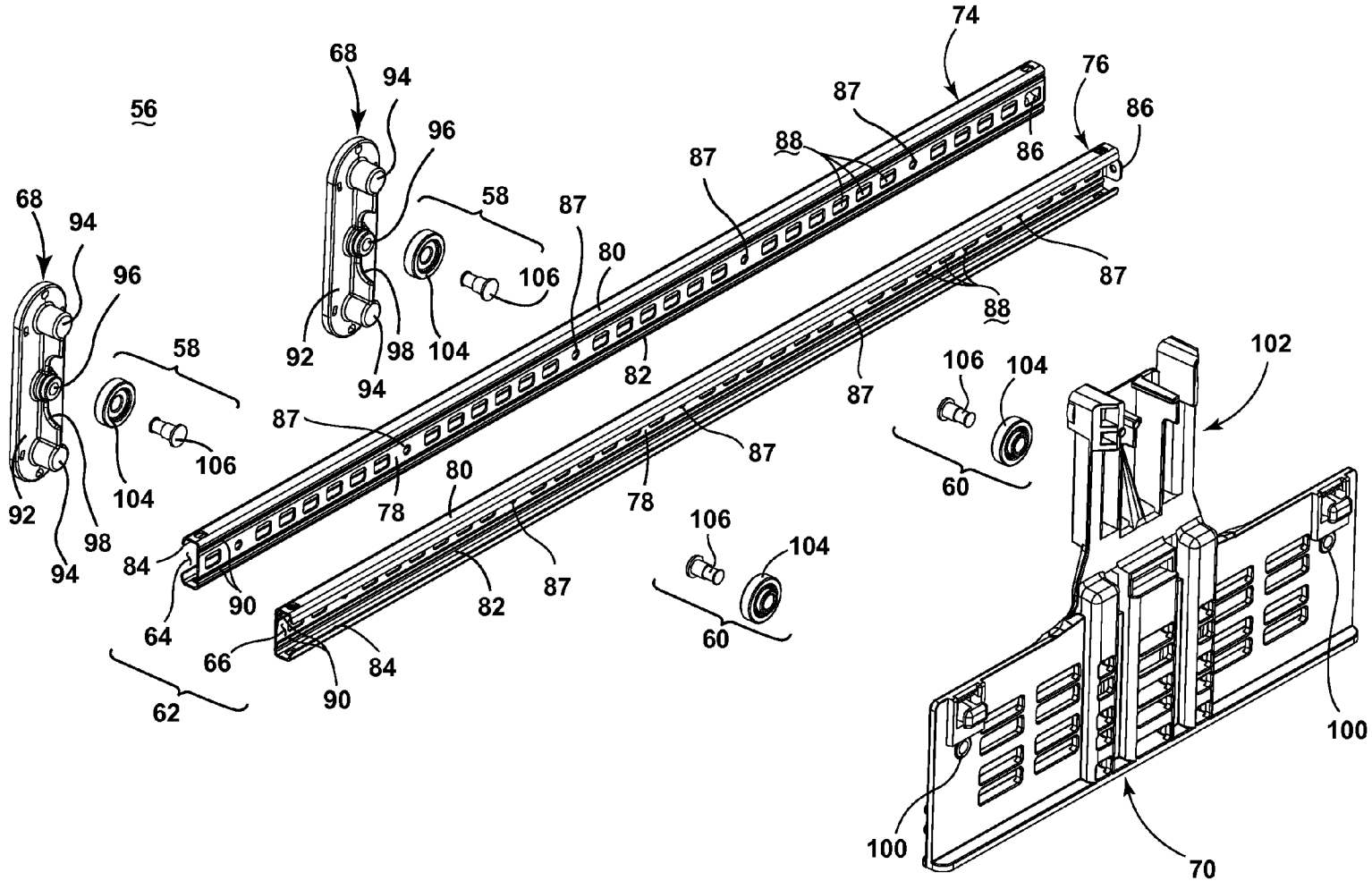
FIG. 4 is an exploded view of the rail assembly of FIG. 3.

FIG. 4 is an exploded view of the rail assembly 56 from FIG. 3. The first C-shaped channel 64 can be defined by a first rail 74 and the second C-shaped channel 66 can be defined by a second rail 76. In the illustrated embodiment, the first and second rails 76 have a similar construction, except that they are mirror image of each other when installed; thus, the rails 74, 76 will not be described separately. Each rail 74, 76 can include an elongated body having a generally vertical middle wall 78, an upper L-shaped wall 80, and a lower L-shaped wall 82 extending from and along the middle wall 78, such that a cross-section of the rail 74, 76 has a C-shape. An elongated opening 84 is positioned opposite the middle wall 78, between the L-shaped walls 80, 82. A stop 86 is formed at one end of the middle wall 78.

The first and second rails 74, 76 can be fixedly attached to each other such that the rails 74, 76 do not move relative to each other. The attachment of the rails 74, 76 can be accomplished with any suitable method, including, but not limited to, welding, mechanical lock, or rivets. As shown, the rails 74, 76 can include fastener openings 87 for receiving mechanical fasteners (not shown) for attaching the rails to each other. As illustrated, the first and second rails 74, 76 can be attached to each other in a position such that the middle walls 78 of the rails 74, 76 are adjacent to each other to arrange the first and second C-shaped channels 64, 66 in the back-to-back relationship. As such, the adjacent middle walls 78 can together define the partition 72 (see in FIG. 3), with the openings 84 facing opposite directions. It is noted that the adjacent middle walls 78 can be replaced with a single partition 72 between the first and second C-shaped channels 64, 66.

The rails 74, 76 can include one or more port(s) 88 formed through the middle wall 78, which provide for the passage of liquid through the middle wall 78. Soil can accumulate in or around the rail assembly 56, and the ports 88 allow liquid to pass through the track 62 to wash out the soil. As illustrated, the middle wall 78 can include multiple ports 88 which extend substantially along the length of the rail 74, 76.

The ports 88 in the rails 74, 76 can be positioned to at least partially overlap, to provide for a continuous passage through the track 62. It is noted, however, that the ends of the first and second rails 74, 76 may be offset from each other, and, therefore, the ports 88 in the first and second rails 74, 76 may not be positioned at the same distances along each rail 74, 76, but rather may be relatively spaced based on the offset in order for the ports 88 to overlap.

The rails 74, 76 can further include one or more glide rib(s) 90 (see FIG. 5 for an enlarged view) at least partially defining the C-shaped channels 64, 66, which function to maintain a space between the wheels 58, 60 and the middle wall 78 to ensure that the wheels 58, 60 do not contact the mechanical fasteners (not shown) received in the fastener openings 87, or the ports 88, thereby, ensuring that the rails 74, 76 slide smoothly over the wheels 58, 60. Each rail 74, 76 can include two vertically-spaced glide ribs 90 that extend horizontally along the length of the middle wall 78. The ribs 90 extend into the space defining the C-shaped channels 64, 66.

In the illustrated embodiment, the rail assembly 56 includes the two tub mounting brackets 68. Each bracket 68 includes a vertically elongated flange 92 having two spaced openings 94 for receiving fasteners (not shown) for attaching the bracket 68 to the tub side wall 52, and a wheel interface 96 between the openings 94 for mounting the first wheel 58. The bracket 68 can also include a recessed portion 98 to allow clearance for the rail 74 and for the wheel 58 to rotate. Therefore, two first wheels 58 are fixed in place relative to the tub 18, but rotatable. Both wheels 58 are received in the first C-shaped channel 64, thereby allowing the first rail 74 to slide along the wheels 58 relative to the tub 18 and brackets 68. Since the second rail 76 is fixedly attached to the first rail 74, the second rail 76 will also slide relative to the tub 18 and brackets 68.

The rack mount 70 is mounted to one side of the rack 24 and includes two wheel interfaces 100 that each mount one of the second wheels 60; therefore, two second wheels 60 are fixed in place relative to the rack 24, but rotatable. Both wheels 60 are received in the second C-shaped channel 66, thereby allowing the rack 24 to slide relative to the rails 74, 76, and the tub 18. The rack mount 70 can further comprise a rack height adjuster 102, as shown in the illustrated embodiment, that is configured to adjust the vertical height of the rack 24 relative to the track 62, thereby adjusting the vertical position of the rack 24 within the treating chamber 20. Such rack height adjusters are well known in the art, and will not be described further herein. Details of a suitable rack height adjuster can be found in U.S. Pat. No. 7,410,228 to Dickson et al., issued Aug. 12, 2008, which is incorporated herein by reference in its entirety. The rack mount 70 can alternatively be a stationary mount that couples the rack 24 with the track 62, but does not allow for height adjustment of the rack. The rack mount 70 can be flexible, for example, by being constructed of a flexible material such as polypropylene or acetal. The flexibility of the rack mount 70 is also affected by the geometry of the rack mount 70.

Each of the wheels 58, 60 include a wheel hub 104 rotatably coupled to an axle 106. In the illustrated embodiment, the first and second wheels 58, 60 have a similar construction, except that they are associated with different rails 74, 76; therefore, the features of the wheels 58, 60 will not be described separately. The axles 106 of the wheels 58, 60 are received by the wheel interfaces 96, 100, respectively, on the brackets 68 and rack mount 70.

Figure 5:
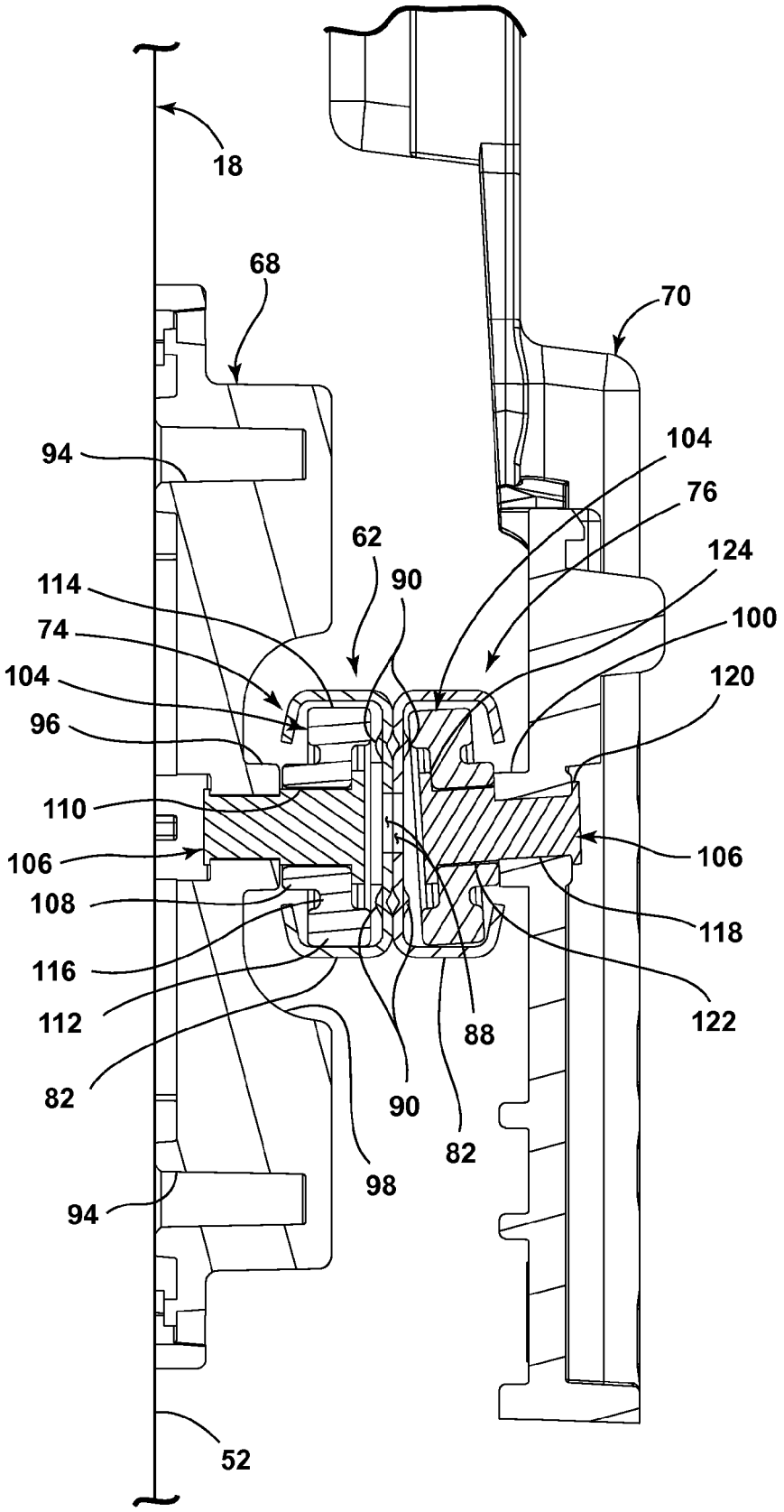
FIG. 5 is a cross-sectional view through the rail assembly of FIG. 3.

FIG. 5 is a cross-sectional view through the rail assembly 56. The wheel hub 104 includes a central portion 108 having a bore 110 for receiving the axle 106, a rim 112 defining a peripheral rotational surface 114, and a neck portion 116 connecting the rim 112 to the central portion 108.

The axle 106 includes a first end 118 which is received in the wheel interface 96, 100 and has a flange 120 abutting an inner surface of the wheel interface 96, 100, and a second end 122 which is received in the bore 110 of the hub 104 and has a flange 124 abutting a surface of the central portion 108. The second end 122 is illustrated as having a slightly larger diameter than the first end 118, although the specific configuration of the axle 106 can be determined based on the configurations of the wheel interface 96, 100 and wheel hub 104.

The wheel hubs 104 are received within the C-shaped channels 64, 66, with the rims 112 resting on, and, therefore, moveable along, the lower wall 82 of the rails 74, 76. The glide ribs 90 confront the face of the rim 112, and prevent the wheel hubs 104 from touching the middle wall 78 of the rails 74, 76 in order to maintain a space between the wheel hubs 104 and the middle walls 78 to ensure that the wheels 58, 60 do not contact the mechanical fasteners (not shown) received in the fastener openings 87, or the ports 88, thereby, ensuring that the rails 74, 76 slide smoothly over the wheels 58, 60.

The materials for the wheel hub 104 and axle 106 can be selected to have a low coefficient of friction, thereby reducing the noise associated with and force required to rotate the wheel hub 104 relative to the axle 106. For example, the materials for the wheel hub 104 and axle 106 may be selected to have a coefficient of friction less than 0.25, more specifically, equal to or less than 0.15, or, even more specifically, ranging between 0.05 to 0.15.

In some examples the axle 106 is a metal axle, illustrated in the drawings as a metal rivet. The metal rivet can mount a plastic wheel hub 104 for rotational movement. The use of a metal rivet or axle 106 can further reduce the noise associated with sliding the rail assembly 56, because the part tolerances associated with a metal axle 106 are smaller than associated with previous plastic axles. Plastic axles are snap-fit with wheel hubs, which require larger part tolerances in order to accommodate the snap action. A larger part tolerance means that there are larger gaps between the axle and hub, which can produce a rattling noise when the wheel hub spins on the axle. Smaller part tolerance means that there are smaller gaps between the wheel hub 104 and axle 106, thereby reducing the rattling noise produced when the wheel hub 104 spins on the axle 106. Another reason that noise is reduced using a metal axle 106 is that prior plastic axles use glass or mineral fillers to stiffen the axle, which generate a lot of noise against the rotating wheel hub. One example of specific materials used for the metal axle 106 is stainless steel, and for the wheel hub 104 is acetal, also known as polyoxymethylene or POM. Stainless steel and acetal have a coefficient of friction of 0.15.

Compared to previous rail systems, the wheel 60 (which is rotatably mounted to the upper rack 24) is intentionally cambered. The angle at which the wheel 60 is cambered is selected so that substantially all of the slop between components (i.e., track 62, wheel hub 105, axle 106, etc.) is taken out and the rail 62 is substantially straight. In some examples, the wheel 60 is cambered downward by 3 degrees. By removing the slop, the ability of a downward force applied to the rail assembly 56 due to, for example, the weight of utensils in the upper rack 24, to rotate, twist or deflect the rail 62 is substantially eliminated or reduced. In stark contrast, when the wheel 60 is not cambered, a downward force will rotate or twist the rail 62 until the slop is removed.

An exemplary operation of the example rail system 54 is described in co-pending related U.S. patent application Ser. No. 13/329,860, which was filed on Dec. 19, 2011, and which is incorporated herein by reference in its entirety.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A dishwasher comprising:

a tub at least partially defining a treating chamber and having a side;

a rack for holding utensils for treatment within the treating chamber;

a first wheel mounted to the side of the tub;

a second wheel mounted to the rack at a fixed non-perpendicular angle relative to the rack, wherein the fixed non-perpendicular angle cambers the second wheel so that a top of the second wheel is further away from the rack than a bottom of the second wheel; and a track having a first C-shaped channel receiving the first wheel, and a second C-shaped channel receiving the second wheel to slidably mount the rack to the tub, with the first and second C-shaped channels in a back-to-back relationship.

2. The dishwasher of claim 1, wherein the fixed non-perpendicular angle is selected to substantially eliminate slop between the second C-shaped channel and the second wheel.

3. The dishwasher of claim 1, further comprising a partition between the first and second C-shaped channels.

4. The dishwasher of claim 3, wherein the partition comprises at least one port to provide for the passage of liquid through the partition.

5. The dishwasher of claim 3, wherein the partition comprises a first wall at least partially defining the first C-shaped channel, and a second wall at least partially defining the second C-shaped channel.

6. The dishwasher of claim 1, wherein the track comprises a first C-shaped rail defining the first C-shaped channel, and a second C-shaped rail defining the second C-shaped channel.

7. The dishwasher of claim 6, wherein the first C-shaped rail comprises a first opening for receiving the first wheel, and the second C-shaped rail comprises a second opening for receiving the second wheel, wherein the first and second openings face opposite directions.

8. The dishwasher of claim 1, wherein the track comprises at least one first glide rib at least partially defining the first C-shaped channel, and at least one second glide rib at least partially defining the second C-shaped channel.

9. The dishwasher of claim 1, further comprising a bracket coupled to the side of the tub, wherein the first wheel is fixedly mounted to the bracket to mount the first wheel to the side of the tub.

10. The dishwasher of claim 1, further comprising a height adjuster coupled to the rack, wherein the second wheel is fixedly mounted to the height adjuster to mount the second wheel to the rack.

11. The dishwasher of claim 1, further comprising a stationary mount coupled to the rack, wherein the second wheel is fixedly mounted to the stationary mount to mount the second wheel to the rack.

12. The dishwasher of claim 1, further comprising a flexible rack mount coupled to the rack, wherein the second wheel is fixedly mounted to the flexible rack mount to mount the second wheel to the rack.

13. The dishwasher of claim 1, wherein the fixed angle is non-perpendicular when no utensils are in the rack and when utensils are in the rack.

* * * * *